US006011573A

United States Patent [19]

Nagahamaya et al.

[11] Patent Number: 6,011,573

[45] Date of Patent: Jan. 4, 2000

[54] MANUFACTURING APPARATUS FOR THERMAL TRANSFER RECORDING MEDIUM AND RENEWING APPARATUS OF THERMAL TRANSFER RECORDING MEDIUM

[75] Inventors: Yuji Nagahamaya; Keiichi Akiyama; Masato Fujii, all of Iwate-ken, Japan

[73] Assignee: Alps Electric Co., Ltd., Tokyo, Japan

[21] Appl. No.: 08/811,999

[22] Filed: Mar. 5, 1997

Related U.S. Application Data

[63] Continuation of application No. 08/585,824, Jan. 11, 1996, abandoned.

[30] Foreign Application Priority Data

Jan. 19, 1995 [JP] Japan ..... 7-024760
Apr. 4, 1995 [JP] Japan ..... 7-078874

[51] Int. Cl.[7] ..... B41J 31/14; B41J 31/16

[52] U.S. Cl. ..... 347/217; 400/197; 400/202; 400/202.2; 427/141

[58] Field of Search ..... 347/171, 217; 400/197, 198, 200, 201, 202, 202.1, 202.2, 202.3, 202.4; 427/141, 140

[56] References Cited

U.S. PATENT DOCUMENTS

| | | | |
|---|---|---|---|
| 3,989,569 | 11/1976 | Newman | 427/140 |
| 4,042,092 | 8/1977 | Newman | 427/141 |
| 5,170,187 | 12/1992 | Oikawa | 347/217 |
| 5,198,835 | 3/1993 | Ando et al. | 347/171 |
| 5,347,344 | 9/1994 | Itoh | 347/217 |
| 5,451,986 | 9/1995 | Mizumoto et al. | 347/217 |

FOREIGN PATENT DOCUMENTS 3-57493 12/1991 Japan .

*Primary Examiner*—Huan H. Tran
*Attorney, Agent, or Firm*—Guy W. Shoup; Patrick T. Bever

[57] ABSTRACT

In a renewing apparatus, a thermal transfer recording medium is made to be used plural times by simple configuration although such a recording medium must be thrown away in the prior art, and the running cost in the printing can be significantly reduced. The apparatus has coating means for applying a thermal transfer recording material including at least one of a photopolymerizing monomer and a photopolymerizing polymer and a coloring agent to a substrate, means for sending the thermal transfer recording medium and means for irradiating light onto the recording material.

10 Claims, 7 Drawing Sheets

MANUFACTURING APPARATUS FOR THERMAL TRANSFER RECORDING MEDIUM AND RENEWING APPARATUS OF THERMAL TRANSFER RECORDING MEDIUM

This application is a continuation of application Ser. No. 08/585,824, filed Jan. 11, 1996 now abandoned.

BACKGROUND OF THE INVENTION

1. Field of the Invention

The present invention relates to an apparatus for manufacturing a thermal transfer recording medium which is used in a thermal transfer recording apparatus, the thermal transfer recording apparatus being utilized as an output terminal device of an information processing apparatus such as a word processor or a facsimile, and also to an apparatus for renewing (recondition) a thermal transfer recording medium in which ink is applied to a previously-used thermal transfer recording medium so that the thermal transfer recording medium can be reused numerous times.

2. Description of the Related Art

At present, various types of printers are used as output terminal devices for information processing apparatuses such as word processors, facsimiles, or computers. These printers employ various recording technologies such as a thermal transfer, electrophotography, ink jet, and wire dot technologies.

Among these recording technologies, thermal transfer printers, which use a heat generating resistance array called a thermal head, are widely used in the prior art because of their silent operation, low cost, miniaturization adaptability, simple operability and high reliability. In recent years, the use of thermal transfer printers has extended from business use to home use, and further to hobby use.

The thermal transfer systems are broadly classified into two types; (1) a fusion type thermal transfer system where ink from a thermal transfer recording medium (such as an ink ribbon) is melted (fused) by heat from a thermal head and transferred to a recording paper made of ordinary paper and (2) a sublimation type thermal transfer system where heat sensitive paper is colored by the heat from a thermal head. At present, the fusion type thermal transfer recording system is mainly used because of its low price.

FIG. 7 shows the basic principle of the above-mentioned fusion type thermal transfer system and the basic configuration of a thermal transfer recording medium used in the fusion type thermal transfer system. As shown in FIG. 7, a thermal transfer recording medium 1, which is generally called an ink ribbon or an ink sheet, is structured such that an ink layer 1*b* is laminated onto a substrate 1*a*.

A high molecular resin film having thickness of 1 to 12 μm is usually used in the substrate 1*a* of the above-mentioned thermal transfer recording medium 1. The substrate 1*a* is composed of general-purpose resins such as polyethylene terephthalate (PET), polyethylene naphthalate (PEN), polyimide (PI), polyether ether ketone (PEEK), and aramid.

On the rear surface of the substrate 1*a*, a lubrication layer 1*e* is generally applied in order to reduce abrasion caused by sliding contact of a thermal head against the thermal transfer recording medium, to stabilize transfer of an ink ribbon between bobbins (when an ink ribbon is used as the thermal transfer recording medium), and to prevent the substrate 1*a* from adhering to the ink layer 1*b* of the ink ribbon when the ink ribbon is wound on the bobbins.

The main components of the ink layer 1*b* of the above-mentioned thermal transfer recording medium 1 are a thermal fusing material, such as low melting wax, and a thermal fusing resin which performs well in close contact with the recording paper. Various types of pigments are used as a coloring agent and various types of plasticizer, dispersant, antioxidant and the like are added in small quantity.

The low melting wax used in the ink layer 1*b* may be, for example, carnauba wax, candelilla wax, rice wax, paraffin wax, microcrystalline wax, and polyethylene wax. These low melting waxes are used alone or in a mixed state.

The thermal fusing resin used in the ink layer 1*b* may include: (1) ethylene series copolymers such as ethylene-vinyl acetate copolymer, ethylene-vinyl butyrate copolymer and ethylene-acryl copolymer; (2) poly(meth)acrylic esters such as polylauryl methacrylate and polyhexyl acrylate; and (3) vinyl chloride series copolymers such as polyvinyl chloride, vinyl chloride-vinyl acetate copolymer and vinyl chloride-vinyl alcohol copolymer. These resins are used alone or in a mixed state.

A thermal head 4 is pressed against the rear side of the substrate 1*a* of the thermal transfer recording medium 1, that is, from the side of the lubrication layer 1*e*. This causes the thermal transfer recording medium 1 to contact a recording paper 5. A heat generating resistance element 4*a*, located at a position corresponding to the desired record, generates heat, thereby fusing or softening ink at a position corresponding to the heat generating resistance element 4*a* such that the fused or softened ink is transferred onto the recording paper. The desired record is therefore obtained by the transferred ink 6.

However, with respect to a thermal transfer recording medium of such a thermal transfer system, once transfer recording is carried out, the thermal transfer recording medium must be thrown away because ink at the position corresponding to the transferred image is removed and thus the thermal transfer recording medium is in a defective state. Therefore, a problem arises because the operating costs of such a thermal transfer system become significantly high.

In order to solve such a problem, a thermal transfer recording medium capable of being used numerous times and a method of renewing a used thermal transfer recording medium have been proposed in the prior art.

FIG. 8 shows an example of a prior art thermal transfer recording medium (ink ribbon) capable of being used numerous times. This ink ribbon is generally called a multi-time ribbon and has been reduced to practice already.

The structure of this multi-time ribbon, as shown in FIG. 8, is such that an ink layer 1*b* is formed through repeated lamination of individual ink layers. The several layers are transferred in sequence from the upper layer during sequential printing operations, thereby realizing numerous recording operations from a single ribbon. In the example shown in FIG. 8, the ink layer 1*b* is constituted of ink layers $\mathbf{1}b_1$, $\mathbf{1}b_2$ in two layers. When such an ink ribbon is used in the printing operation for the first time, the ink layer $\mathbf{1}b_1$ is used for printing. When the ink ribbon is used in the printing operation for the second time, the remaining part of the ink layer $\mathbf{1}b_1$, that was not transferred in the first printing operation, and the ink layer $\mathbf{1}b_2$ are used for printing.

With respect to the surface of the thermal transfer recording medium 1, after transfer of the first time as shown in FIG. 8, level differences are produced between a portion from which ink is transferred and a portion from which ink is not transferred. Therefore, since the surface of the ink layer 1*b* is uneven, close contact between the recording paper 5 and the ink layer 1*b* of the thermal transfer recording medium 1 is deteriorated during the second printing operation. This creates a problem in that every time the printing is repeated, the printing quality gradually deteriorates. Consequently, from the viewpoint that the goal is to maintain quality while reducing the operating cost, this method falls short.

This also sets a limit on the number of ink layers laminated on the ink ribbon, and thus the number of printing operations per ink ribbon, because the unevenness increases as the number of ink layers increases.

An example of a prior art method for renewing a thermal transfer recording medium is proposed in Japanese Patent Laid-Open No. Hei 6-286333 (1994). According to this method, a corona charging processing is applied to the ink layer of a used thermal transfer recording medium such that powder toners adhere to an ink lacking portion of the ink layer where ink has been removed due to a previous printing operation. The adhered powder toners are then fused by heat, and then a uniform leveling processing is carried out, thereby renewing the thermal transfer recording medium into a reusable state.

In this renewing method, however, since corona charging is utilized in similar manner to that used in a common electrophotography apparatus, a high voltage source is required. This causes a problem because the size of the apparatus is large and the cost inevitably becomes high.

Since the toners to be used in the renewing of the ink layer are powders, it is difficult to make the grain size of the toners uniform. A problem also exists in that since the charge quantity of toners is significantly dependent on humidity, control of the adhering amount of toners is quite difficult.

Further, since the average grain size of toners is about 10 $\mu$m, a problem exists because, from the viewpoint of size, it is difficult for the powder toners to fill the ink lacking portions (having a size on the order of several $\mu$m) of an ink layer with high precision.

SUMMARY OF THE INVENTION

An object of the present invention is to provide an apparatus for manufacturing a thermal transfer recording medium where a thermal transfer recording medium is manufactured in simple configuration and reduced price. In turn, this will significantly reduce the operating cost of printing.

Another object of the present invention is to provide an apparatus having a simple configuration for renewing a previously-used thermal transfer recording medium such that a thermal transfer recording medium can be used numerous times, whereas such a used thermal transfer recording medium must be thrown away in the prior art. This also significantly reduces the operating cost of the printing.

As a method for hardening a liquid ink layer in a apparatus for manufacturing a thermal transfer recording medium of the present invention, light is irradiated onto a liquid recording material applied onto a substrate.

Further according to an apparatus for renewing a thermal transfer recording medium of the present invention, a recording material is applied by recording material coating means to an ink lacking portion of a thermal transfer recording medium which is transferred by sending means. Light is irradiated onto the recording material by light irradiating means, whereby the recording material applied to the ink lacking portion is hardened and the ink lacking portion is repaired. If necessary, cleaning means remove a surplus amount of liquid thermal transfer recording material applied to a portion other than an ink lacking portion.

The above and further objects and novel features of the invention will more fully appear from the following detailed description when the same is read in connection with the accompanying drawings. It is to be expressly understood, however, that the drawings are for the purpose of illustration only and are not intended as a definition of the limits of the invention.

DESCRIPTION OF THE PREFERRED EMBODIMENTS

The present invention will be described by way of embodiments shown in the accompanying drawings as follows.

At first, a thermal transfer recording material of the present invention and a thermal transfer recording medium using this material will be described using FIG. 1.

Figure 1A:
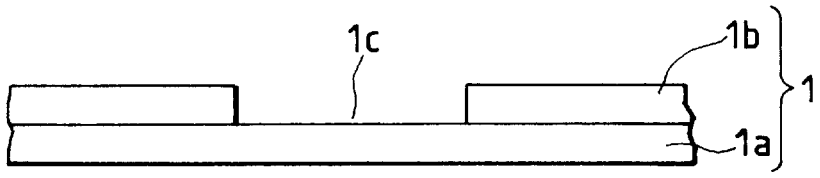
FIGS. 1A, 1B, 1C, 1D and 1E are schematic sectional views explaining a configuration of a first embodiment of a thermal transfer recording medium of the invention and a renewing method thereof.

As shown in FIG. 1A, a thermal transfer recording medium 1 of the present invention is composed of an ink layer 1*b*, made of a thermal transfer recording material, laminated onto a substrate 1*a*. The thermal transfer recording material of the ink layer 1*b* is composed of an ultraviolet setting resin as the main component. This resin is hardened by irradiating ultraviolet light onto it. If necessary, an ultraviolet absorbing agent, a coloring agent and other additives of small quantity are mixed in about 0 to 10% with the ultraviolet setting resin.

The ultraviolet setting resin is mainly composed of three components, a photopolymerizing prepolymer, a photopolymerizing monomer and an optical initiator. Among these, the photopolymerizing prepolymer is usually added in the range of 0 to 99 parts by weight and serves as the framework of the resin.

The photopolymerizing prepolymer is a polymer further polymerized by photochemical reaction, and is also called a photopolymerizing unsaturated polymer or a photopolymerizing origomer.

The photopolymerizing monomer fills the role of diluent of the photopolymerizing prepolymer, and secures the practical workability of ink by being added in the range of 0 to 99 parts by weight. The photopolymerizing monomer also takes part in the polymerization reaction by action of end functional group during the ultraviolet irradiation. The photopolymerizing monomer can be classified as a monofunctional monomer or a multifunctional monomer by the number of functional groups. The multifunctional monomer plays the role of a bridging agent which carries out bridge formation between high molecular compounds.

The optical initiator absorbs the ultraviolet light and becomes a trigger of the polymerization reaction.

In addition to the three components as above described, adding agents such as a sensitivity intensifying agent, a pigment, a filler, a leveling agent and a viscosity improving agent are further mixed, if necessary, into the thermal transfer recording material constituting the ink layer 1*b* in this embodiment.

Examples of preferable photopolymerizing prepolymers used in a thermal transfer recording material of the present invention are polyester acrylate, epoxy acrylate, urethane acrylate, polyether acrylate, or polyacrylate.

Examples of preferable photopolymerizing monomers are: (1) monofunctional types such as 2-ethylhexyl acrylate, 2-hydroxyethyl acrylate, 2-hidroxypropyl acrylate, tetrahydrofurfuryl acrylate and derivatives of tetrahydrofurfuryl acrylate; (2) bifunctional types such as dicyclopentenyl acrylate, dicyclopentenyl oxyethyl acrylate, 1,3-butanediol acrylate, 1,4-butanediol acrylate, 1,6-hexanediol acrylate, diethylene glycol diacrylate, neopentyl glycol diacrylate, polyethylene glycol 400 diacrylate, hydroxy pivalic ester neopentyl glycol diacrylate, tripropylene glycol diacrylate, 1,3-bis (3-acryl oxyethoxy-2-hydroxypropyl)-5, 5-dimethyl hidantoin and diacrylate of derivative of hydroxy pivalic ester neopentyl glycol; and (3) trifunctional types or more such as trimethyl propane triacrylate, pentaerythritol triacrylate or dipentaerythritol hexacrylate.

Examples of preferable optical initiators are: biacetyl, acetophenone, benzophenone, Michler's ketone, benzyl, benzoin, benzoin isobutyl ether, benzyldimethyl ketal, tetramethyl thiuram sulfide, azo bis isobutyl nitrile, benzoyl peroxide, di-tert-butyl peroxide, 1-hydroxy cyclohexyl phenyl ketone, 2-hydroxy-2-methyl-1-phenyl-propane-1-one, 1-(4-isopropyl phenyl)-2-hydroxy-2-methyl-propane-1-one, 2-chloro thioxanthone, or methylbenzoyl formate.

Possible coloring agents are black pigments such as carbon black, acetylene black and oil black as well as white pigments such as titanea and calcium carbonate and known dyestuffs such as yellow, magenta and cyan. Adding quantities of these pigments or dyestuffs can be suitably varied, whereby tone or the like can be adjusted to desired state.

Next, a method of renewing (reconditioning) a thermal transfer recording medium of this embodiment will be described based on FIG. 1.

Figure 1B:
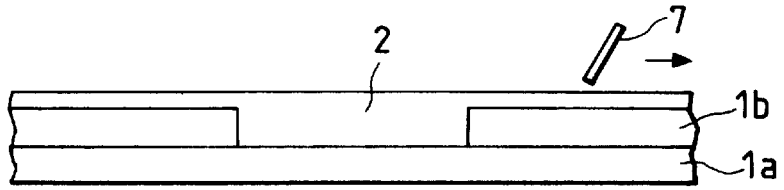

A method of renewing a thermal transfer recording medium of this embodiment, in order to renew a used ink ribbon as shown in FIG. 1A into a reusable state, comprises three steps: (1) the step of applying a thermal transfer recording material in the above-mentioned constitution onto the whole surface of the thermal transfer recording medium 1, including an ink lacking portion 1*c* (FIG. 1B); (2) the step of irradiating ultraviolet light onto the thermal transfer recording medium 1 from the rear side, that is, from the side of the substrate 1*a*, thereby hardening the thermal transfer recording material applied into the ink lacking portion 1*c* (FIG. 1C); and (3) the step of removing a surplus amount of thermal transfer recording material which was applied to a portion other than the ink lacking portion 1*c* (FIG. 1D). When renewing a thermal transfer recording medium 1 that performs high precision printing, an anneal step (FIG. 1E) may be added where a boundary part 3 between a renewed ink layer 2*a* and a remaining ink layer 1*b* is eliminated by melting the ink.

Describing this further, in FIG. 1A, the thermal transfer recording medium 1, such as an ink ribbon, has an ink sheet or the like which has been used. The ink layer 1*b* remains on the substrate 1*a* and is not used for the printing. The ink lacking portion 1*c* is formed on the substrate 1*a* between this pair of ink layers 1*b*, 1*b* since the ink layer is transferred and recorded to the printing paper.

In order to renew the used thermal transfer recording medium 1, in a step shown in FIG. 1B, coating ink 2 made of the thermal transfer recording material in the above-mentioned constitution is applied to the whole surface of the thermal transfer recording medium 1, including the ink lacking portion 1*c*, by a roller or the like. Then a film thickness control device 7, such as a knife or a blade, is moved whereby the film thickness of the coating ink 2 is equalized. The resulting film thickness of the applied coating ink 2 is ideally equal to the film thickness of the ink lacking portion 1*c*, but even if the coating quantity is excessive as in this embodiment or even if the ink adheres onto the surface of the remaining ink layer 1*b*, no particular problem is produced on account of a cleaning step as described later.

Figure 1C:
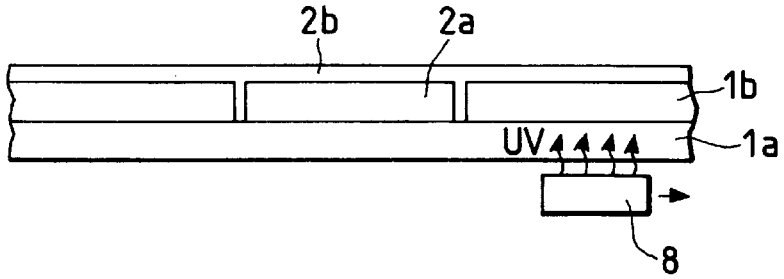
Figure 1D:
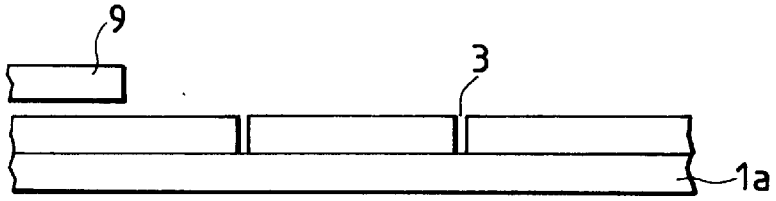

Next, in a step shown in FIG. 1C, ultraviolet light is irradiated onto the whole surface of the thermal transfer recording medium 1 by an ultraviolet irradiator 8 from the side of the substrate 1*a*, i.e., from the rear side of the thermal transfer recording medium 1, to the whole surface of which the coating ink 2 is applied. Examples of a light source acting as the ultraviolet irradiator 8 include a mercury lamp of low or high pressure, a mercury xenon and a metal halide lamp.

The remaining ink layer 1*b* is not affected by the ultraviolet irradiation because it is already solidified (hardened). The coating ink 2 applied onto the remaining ink layer 1*b* is also not affected by the ultraviolet irradiation because the irradiated ultraviolet light is absorbed by the remaining ink layer 1*b* and therefore, is not transmitted to the surface. The surplus coating ink is thereby held in a liquid state.

On the other hand, since the ultraviolet light transmitted through the transmissive substrate 1*a* is irradiated onto the coating ink 2 which was applied to the ink lacking portion 1*c*, the coating ink 2 is hardened by the polymerization reaction and is renewed as an ink layer 2*a*.

Thus, according to a method of renewing a thermal transfer recording medium of this embodiment, only the coating ink 2 existing at the ink lacking portion 1*c* can be hardened.

In addition, the film thickness of the renewed ink layer 2*a* can be suitably controlled depending on hardening conditions such as ultraviolet irradiation time, power, or wavelength and the properties of used materials.

Next, in a cleaning step of FIG. 1D, surplus coating ink 2*b* that was not hardened by the polymerization reaction in the ultraviolet irradiating process shown in FIG. 1C is removed by a cleaning roller 9 whereby the renewing process of one cycle is finished.

Figure 1E:
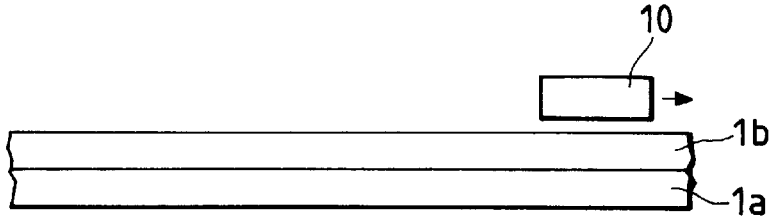

When renewing a thermal transfer recording medium 1 designed to perform high precision printing, an anneal step may be added. This anneal step eliminates a boundary part 3 between the remaining ink layer 1*b* and the newly renewed ink layer 2*a* through the use of heat anneal processing from the surface side of the ink layer 1*b* using a heating device 10 such as a halogen lamp, as shown in FIG. 1E. As means for carrying out the heat anneal processing, besides the non-contact heating system using the light source of the halogen lamp as described above, the contact heating system using a thermal head may be utilized.

Next, an apparatus for renewing a thermal transfer recording medium of the present invention and a thermal transfer printer including this renewing apparatus will be described using FIG. 2 and FIG. 3, respectively.

Figure 2:
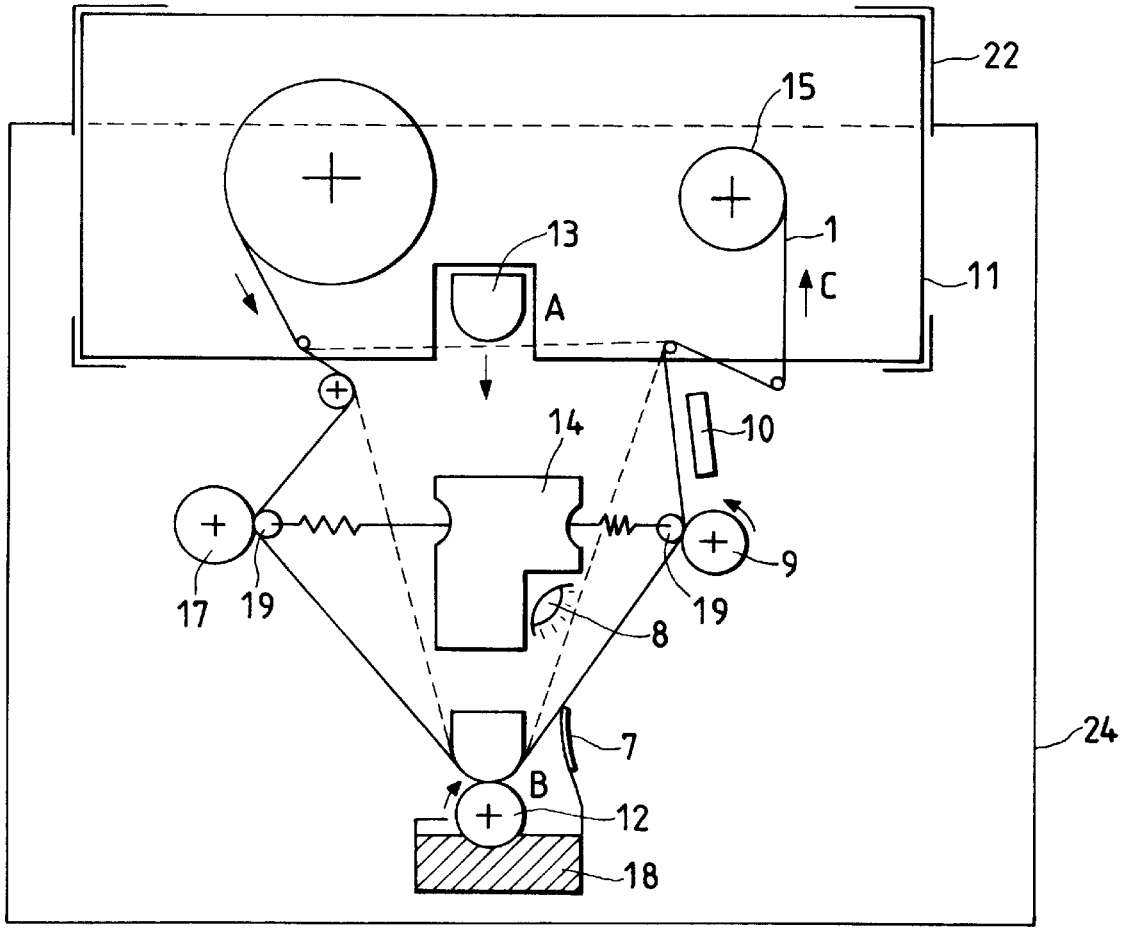
FIG. 2 is a schematic configuration diagram showing an embodiment of an apparatus for renewing a thermal transfer recording medium of the invention.

FIG. 2 is a schematic configuration diagram showing an embodiment of an apparatus for renewing a thermal transfer recording medium of the present invention.

In a ribbon cassette 11 enclosing a thermal transfer recording medium 1 such as an ink ribbon, the thermal transfer recording medium 1 is guided by a plurality of guide rollers and its traveling is controlled so that the thermal transfer recording medium 1 can be transported stably within the ribbon cassette 11. At a portion indicated by A in the figure of the ribbon cassette 11 is provided a recess where a thermal head (not shown) is positioned during the recording operation.

In a renewing apparatus 24 of this embodiment, a holder 22 is formed so as to hold the ribbon cassette 11 enclosing a thermal transfer recording medium, which is used once and must be renewed. When the ribbon cassette 11 is held on the holder 22, a tension head 13 is held to a position facing the inside of the recess A of the held ribbon cassette 11 and is moved in the vertical direction in FIG. 2 by driving means (not shown). A recording material tank 18 is arranged under the recess A of the ribbon cassette 11 held on the holder 22 in FIG. 2, and is filled with the liquid thermal transfer recording material as above described. A recording material feed roller 12, rotated by driving means (not shown), is arranged within the recording material tank 18, and when the recording material feed roller 12 is rotated, the thermal transfer recording material in the recording material tank 18 is pumped up and adheres to the outer circumferential surface.

When the ribbon cassette 11 is installed to the holder 22 and a renewing signal is inputted, the tension head 13 is moved to a position B spaced from the inside of the recess A of the ribbon cassette 11 by several millimeters to several centimeters whereby the thermal transfer recording medium 1 is drawn from the ribbon cassette 11 in a hooked state by the tension head 13 and the surface of the thermal transfer recording medium 1 is pressed against the recording material feed roller 12. In the vicinity of the recording material feed roller 12, a film thickness control device 7 comprising a blade is installed so as to ensure uniform film thickness of the thermal transfer recording material applied to the thermal transfer recording medium 1 by the recording material feed roller 12.

On both sides of a nearly intermediate position of the moving route of the tension head 13, a guide roller 17 and a cleaning roller 9 are arranged and spaced laterally so as not to interfere with the thermal transfer recording medium 1 drawn from the ribbon cassette 11 when it is hooked by the tension head 13. At a crossing position of an imaginary segment connecting the rollers 17 and 9 and the moving route of the tension head 13, a tension unit 14 is arranged and is moved in the orthogonal direction with respect to the paper plane by the driving means (not shown). The tension unit 14 has a pair of tension rollers 19, 19 which respectively abut one of the rollers 17 and 9 with elasticity, and can be moved when the tension unit 14 is positioned to the advanced position on the same vertical plane as that of rollers 17 and 9.

The thermal transfer recording medium 1 is transported in the direction indicated by arrow C in the figure. Consequently, the thermal transfer recording medium 1 is placed in contact with the recording material feed roller 12 and then placed in contact with the cleaning roller 9.

The ultraviolet irradiator 8, used to harden the thermal transfer recording material applied to the thermal transfer recording medium 1, is arranged on the inside of the thermal transfer recording medium 1 so as to irradiate ultraviolet light onto the substrate of the thermal transfer recording medium 1 between the recording material feed roller 12 and the cleaning roller 9. Also, at the downstream side of the cleaning roller 9 in the traveling direction of the thermal transfer recording medium 1, a heating device 10 for anneal processing of the thermal transfer recording material on the thermal transfer recording medium 1 is arranged in opposition to the thermal transfer recording material on the thermal transfer recording medium 1.

Next, operation of the renewing apparatus of this embodiment will be described.

The ribbon cassette 11 is installed to the holder 22, the tension head 13 is moved from A to B in the figure, the thermal transfer recording medium 1 is hooked to the tension head 13 and drawn out of the ribbon cassette 11, and its surface at the opposite side to the substrate is pressed to the recording material feed roller 12. Subsequently, the tension unit 14 in the retracted position is moved in the vertical direction (upward with respect to the paper plane of FIG. 2) and is stopped at the advanced position, the pair of tension rollers 19, 19 supported by the tension unit 14 are pressed to the guide roller 17 and the cleaning roller 9, and the thermal transfer medium 1 is grasped between the tension roller 19 and the guide roller 17 and between the tension roller 19 and the cleaning roller 9 respectively, thus the preparation of the transporting system of the thermal transfer recording medium 1 is finished. In this state, a winding bobbin 15 of the ribbon cassette 11 is driven for rotation by the driving means (not shown) installed at the renewing apparatus 24 whereby the thermal transfer recording medium 1 is transported in the direction shown by arrow C. Due to the transporting of the thermal transfer recording medium 1, the thermal transfer recording material is applied to the whole surface of the thermal transfer recording medium 1 by the recording material feed roller 12. Then, the film thickness of the thermal transfer recording material applied onto the thermal transfer recording medium 1 is made uniform by the film thickness control device 7. Ultraviolet light is then irradiated from the rear side of the thermal transfer recording medium 1 by the ultraviolet irradiator 8 whereby only the thermal transfer recording material applied to the ink lacking portion is hardened and the ink layer is renewed in the ink lacking portion.

Thereafter, the cleaning roller 9 removes a surplus amount of thermal transfer recording material which is applied to a portion of the thermal transfer recording medium other than the ink lacking portion, i.e., to a portion of the remaining ink layer, and thus, is not hardened by the ultraviolet irradiation. Anneal processing by the heating device 10 eliminates the boundary part between the renewed ink layer of the thermal transfer recording medium 1 and the remaining ink layer of the thermal transfer recording medium 1. This completes a series of the renewing process of the thermal transfer recording medium 1.

Although this embodiment has been described as an example of the thermal transfer recording medium where the ink layer is a single layer, when the ultraviolet irradiation condition in the renewing method of the present invention is adjusted, of course, the present invention can be applied also to the renewal of the thermal transfer recording medium in lamination configuration of a multi-time ribbon or the like. A similar configuration can also be used as an apparatus for manufacturing a thermal transfer recording medium.

Figure 3:
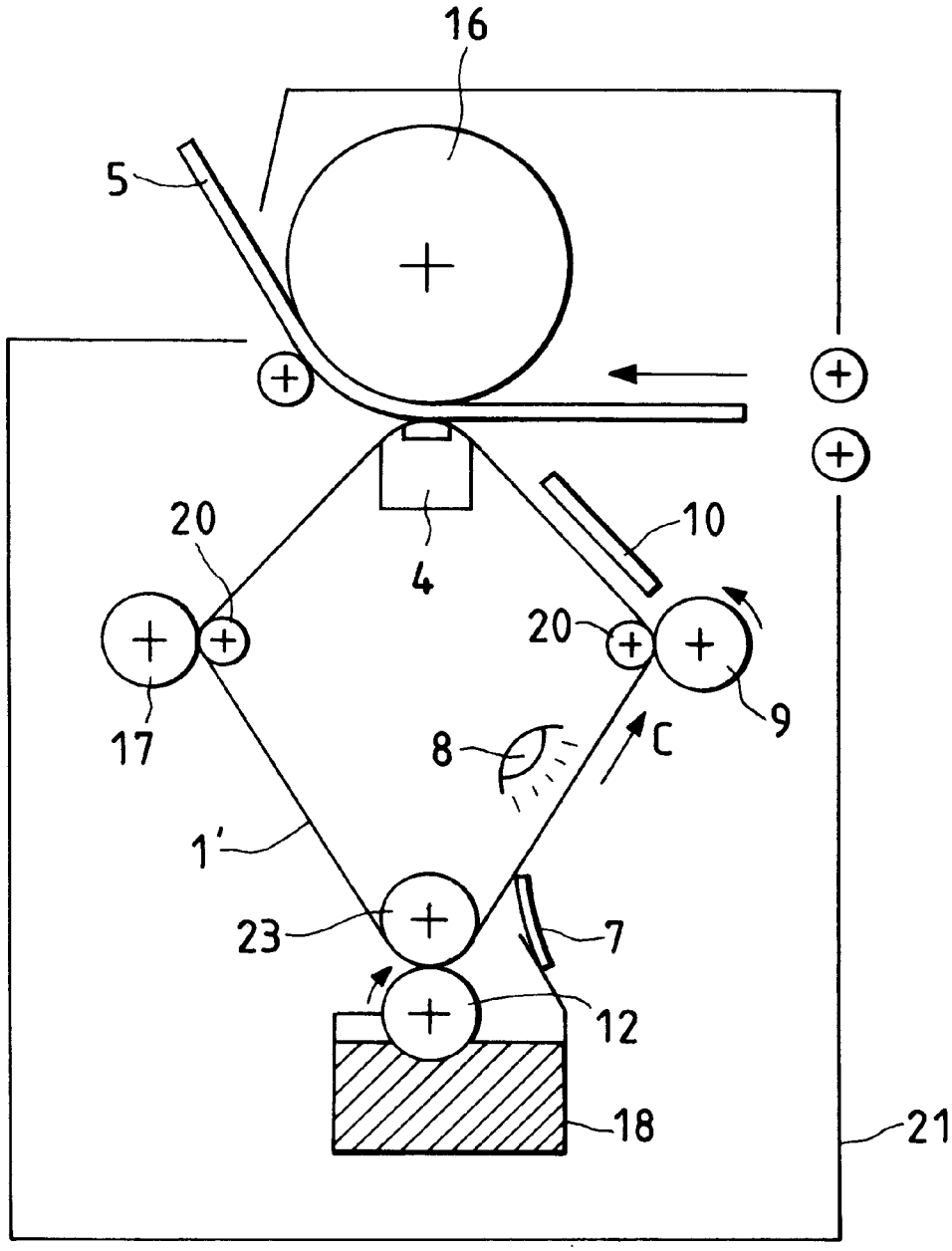
FIG. 3 is a schematic configuration diagram showing an embodiment of a thermal transfer recording apparatus of the invention.

Next, FIG. 3 is a schematic configuration diagram showing an embodiment of a thermal transfer recording apparatus of the present invention where an apparatus for renewing a thermal transfer recording medium is provided within the body of the recording apparatus, whereby the printing/recording and renewal of a used thermal transfer recording medium are carried out simultaneously. Therefore, an ink ribbon cassette can be continuously used for a long period without exchanging. In the following description, the same elements used and described in FIG. 2 are designated by the same symbols, and a detailed description of these elements shall be omitted.

FIG. 3 shows a thermal transfer recording apparatus body 21 in which an endless ink ribbon 1', as a thermal transfer recording medium with an ink layer of the thermal transfer recording material laminated and applied thereon, is held in tension on a substrate film of endless state with both ends connected, by (1) a pair of guide rollers 20, 20, (2) a pressure roller 23 pressed to an ink feed roller 12 through the ink ribbon 1', and (3) a thermal head 4. The ink ribbon 1' is transported at constant speed by a driving mechanism (not shown). In order to withstand long term use, the substrate film is preferably composed of polyimide or polyamide due to its high heat-resistivity and mechanical abrasiveness.

A platen roller 16, provided to hold and transport a recording paper 5 used for the printing recording, is arranged within the body 21, and the endless ink ribbon 1' is pressed against the platen roller 16 by the thermal head 4, and the desired printing recording is carried out.

Next, operation of the thermal transfer recording apparatus of this embodiment will be described.

First, a recording paper 5 is sent between a thermal head 4 and a platen roller 16. Then, ink from an endless ink ribbon 1' positioned between the recording paper 5 and the thermal head 4 is subjected to thermal transfer by the thermal head 4 as in a usual thermal transfer recording apparatus and the desired printing recording is carried out.

An ink lacking portion produced in the ink ribbon 1' by this ink transfer is moved to a recording material feed roller 12 located opposite the platen roller 16 by transferring the ink ribbon 1'. In this position, a thermal transfer recording material within a recording material tank 18 is pumped up to the recording material feed roller 12 and applied to the whole surface of the ink ribbon 1'. The film thickness of the applied thermal transfer recording material is controlled by a film thickness control device 7. Ultraviolet light is irradiated from the rear side by an ultraviolet irradiator 8, and the thermal transfer recording material applied to the ink lacking portion is hardened whereby the ink layer is renewed.

A surplus amount of thermal transfer recording material, which is applied to a portion of the thermal transfer recording medium 1 other than the ink lacking portion, i.e, to a portion of the remaining ink layer, and thus, not solidified by the ultraviolet irradiation, is removed by a cleaning roller 9. A heating device 10 eliminates the boundary part between the renewed ink layer and the remaining ink layer by anneal processing. This completes a series of the renewing process of the thermal transfer recording medium, and the renewed ink ribbon 1' is sent to the thermal head 4 and is used in the printing recording again.

Due to the thermal transfer recording apparatus of this embodiment, the ink ribbon 1' can be used repeatedly without any troublesome work such as installation, reversing, or exchanging of the ink ribbon cassette even though this was carried out in the prior art. The operability is improved significantly and the operating cost can be significantly reduced since only the recording material tank need be filled after numerous renewals of the thermal transfer recording medium.

Next, preferred embodiments of the present invention will be further described.

Embodiment 1

Ultraviolet setting ink, as a thermal transfer recording material, was prepared by adding: (1) hydroxyl alkyl methacrylate (75 parts by weight), acrylic acid (10 parts by weight) and polyurethane dimethacrylate (10 parts by weight) as an ultraviolet setting resin; (2) a compound of acetophenone series (5 parts by weight) as an optical reaction initiator; and (3) carbon black (20 parts by weight) as a coloring agent.

The prepared ink was put into a coating liquid pan, and PET film surface of 3.5 $\mu$m in thickness, manufactured by Teijin, Ltd. and subjected to the rear surface processing by Saimac US350/MEK solution manufactured by Toa Gosei Chemical Industry Co., Ltd., was subjected to the gravure coating. Ultraviolet light having a center wavelength of 365 nm and 20 mW/cm$^2$ was then irradiated onto the whole surface of the film from the PET rear surface for 3 minutes whereby the ink was hardened and an ink ribbon as the thermal transfer recording medium was manufactured.

When this ink ribbon was installed to a thermal transfer printer (resolving power 400 dpi) manufactured by Star Seimitsu Company and the printing was carried out, image of good edge reproducibility was obtained in the image density 1.3.

Then, the used ink ribbon was placed in a renewing apparatus of configuration shown in FIG. 2. The application of ink to the ink lacking portion was carried out through the above-mentioned method using ink of the above-mentioned composition. Since the ink used in this embodiment is insoluble to an organic solvent after the ultraviolet irradiation, a felt cleaner comprising a cleaning roller with an outer surface covered by felt was used as a cleaning device and was impregnated with a small amount of organic solvent. The surplus ink adhering to a portion other than the ink lacking portion was therefore removed. In this embodiment, however, a dry type cleaning method not using an organic solvent can be applied.

When the ink ribbon, renewed in such manner, was installed to the printer and the printing was carried out again, image of good edge reproducibility was obtained in the image density 1.3, and was by no means inferior to the preceding case.

Embodiment 2

Ultraviolet setting ink, as a thermal transfer recording material, was prepared by adding: (1) hydroxyl alkyl methacrylate (98 parts by weight) and benzoyl peroxide (one part by weight) as an ultraviolet setting resin; (2) a compound of acetophenone series (one part by weight), and saccharin and N, N-dialkyl toluidine respectively of small amount not more than one part by weight as an optical reaction initiator; and (3) carbon black (15 parts by weight) as a coloring agent.

The prepared ink was put into a coating liquid pan, and PET film surface of 3.5 μm in thickness manufactured by Teijin, Ltd. subjected to the rear surface processing by Saimac US350/MEK solution manufactured by Toa Gosei Chemical Industry Co., Ltd. was subjected to the gravure coating. Ultraviolet light having a center wavelength of 365 nm and 8 mW/cm$^2$ was then irradiated onto the whole surface of the film from the PET rear surface for 15 minutes whereby the ink was hardened and an ink ribbon as the thermal transfer recording medium was manufactured.

When this ink ribbon was installed to a thermal transfer printer (resolving power 400 dpi) manufactured by Star Seimitsu Company and the printing was carried out, image of good edge reproducibility was obtained in the image density 1.4.

Then, the used ink ribbon was placed in a renewing apparatus having the configuration shown in FIG. 2, ink having the above-mentioned composition was coated on the ribbon, and ultraviolet irradiation was preformed in accordance with a method and procedure similar to the above-mentioned first embodiment, thereby renewing the ink lacking portion of the ink ribbon. Also, the surface of the renewed ink ribbon was washed using a felt cleaner.

When the ink ribbon, renewed in such manner, was installed to the printer and the printing was carried out, image having good edge reproducibility was obtained in the image density 1.4, and was by no means inferior to the preceding case.

Embodiment 3

Ultraviolet setting ink, as a thermal transfer recording material, was prepared by adding: (1) hydroxyl alkyl methacrylate (80 parts by weight), acrylic acid (15 parts by weight) and polyurethane dimethacrylate (2 parts by weight) as an ultraviolet setting resin; and (2) a compound of acetophenone series (3 parts by weight) as an optical reaction initiator.

The prepared material was put into a coating liquid pan, and PET film surface of 3.5 μm in thickness manufactured by Teijin, Ltd. subjected to the rear surface processing by Saimac US350/MEK solution manufactured by Toa Gosei Chemical Industry Co., Ltd. was subjected to the gravure coating. Ultraviolet light having a center wavelength of 365 nm and 10 mW/cm$^2$ was then irradiated onto the whole surface of the film for 30 seconds whereby the ink was hardened and a first layer as a release layer was formed.

Subsequently, an ink paste was prepared by fusing, mixing, and then kneading by a roller mill, a material comprising ethylene-vinyl acetate copolymer (30 parts by weight), carnauba wax (45 parts by weight) and carbon black (25 parts by weight). The ink paste was solved by toluene and formed an ink coating liquid of 0.1 g/cc. The ink coating liquid was subjected to solvent coating by a gravure coating machine and a second layer as an ink layer was formed to thereby manufacture an ink ribbon as a thermal transfer recording medium comprising the release layer and the ink layer.

When this ink ribbon was installed to a thermal transfer printer (resolving power 400 dpi) manufactured by Star Seimitsu Company and printing was carried out, image of good edge reproducibility was obtained in the image density 1.6.

Then, the used ink ribbon was placed in a renewing apparatus in configuration shown in FIG. 2, coating of the above-mentioned ultraviolet setting material and ultraviolet irradiation were carried out in the above-mentioned method and procedure to thereby renew the first layer as a release layer. The ink coating liquid was laminated and coated whereby the second layer was formed and the ink lacking portion was renewed.

When the renewed ink ribbon was installed to the printer and the printing was carried out again, image of good edge reproducibility was obtained in the image density 1.6, and was by no means inferior to the preceding case.

Embodiment 4

An ink paste was prepared by fusing, mixing, and then kneading by a roller mill, a material comprising carnauba wax (75 parts by weight) and carbon black (25 parts by weight). The ink paste was solved by toluene and formed an ink coating liquid of 0.1 g/cc.

The prepared ink was put into a coating liquid pan, and PET film surface of 3.5 μm in thickness manufactured by Teijin, Ltd. subjected to the rear surface processing by Saimac US350/MEK solution manufactured by Toa Gosei Chemical Industry Co., Ltd. was subjected to the gravure coating to thereby form a first layer.

Ultraviolet setting material was prepared by adding: (1) hydroxyl alkyl methacrylate (65 parts by weight), acrylic acid (25 parts by weight) and polyurethane dimethacrylate (5 parts by weight) as an ultraviolet setting resin; and (2) a compound of acetophenone series (5 parts by weight) as an optical reaction initiator. The ultraviolet setting material was then applied onto the first layer.

Ultraviolet light having a center wavelength of 365 nm and 100 mW/cm$^2$ was irradiated onto the whole surface from the upper surface side of the PET film for 30 seconds whereby the ink was hardened and the second layer was formed.

When this ink ribbon was installed to a thermal transfer printer (resolving power 400 dpi) manufactured by Star Seimitsu Company and printing was carried out, image of good edge reproducibility was obtained in the image density 1.1.

Next, FIG. 4 shows another embodiment of a method of renewing a thermal transfer recording medium whose embodiment has already been described in FIG. 1. In the method of renewing the thermal transfer recording medium of this embodiment, since steps in FIG. 4A and FIG. 4B are similar to those in FIG. 1A and FIG. 1B, the description shall be omitted and only later steps will be described.

Figure 4A:
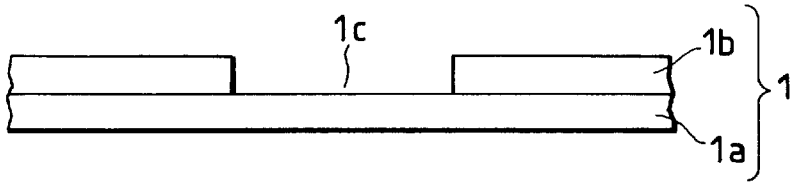
FIGS. 4A, 4B, 4C and 4D are schematic sectional views explaining a configuration of the first embodiment of a thermal transfer recording medium of the invention and a renewing method thereof.
Figure 4B:
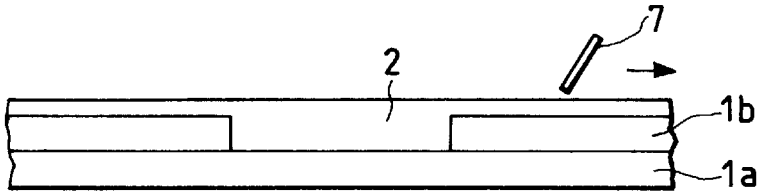
Figure 4C:
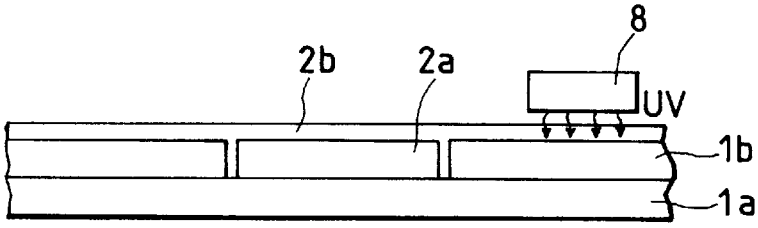
Figure 4D:
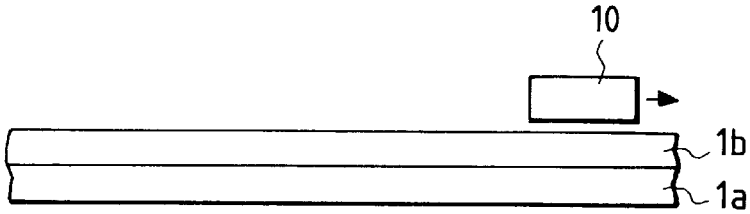

As shown in FIG. 4B, a thermal transfer recording material, having a similar constitution to that above described, is applied to the whole surface of a thermal transfer recording medium 1 including an ink lacking portion 1*c*. Then, as shown in FIG. 4C, ultraviolet irradiation is carried out from the front surface side of the thermal transfer recording medium 1, i.e., from the side of an ink layer 1*b*, rather than from the rear side as in other embodiments, to thereby harden all applied thermal transfer recording material. Since ultraviolet irradiation is carried out from the side of the ink layer 1*b* of the thermal transfer recording medium 1 as above described, a cleaning step to remove a surplus amount of thermal transfer recording material is unnecessary. In addition, in order to renew a thermal transfer recording medium 1 used in high precision printing, an anneal step as shown in FIG. 4D, in similar manner to FIG. 1E, may be added where a boundary part 3 between a renewed ink layer 2*a* and a remaining ink layer 1*b* is eliminated by fusing the ink.

As described above, the cleaning step can be omitted since the ultraviolet irradiation is carried out from the front surface side of the thermal transfer recording medium 1, i.e., from the side of the ink layer 1*b*, and the applied thermal transfer recording material is entirely hardened. Furthermore, since the ultraviolet light is not irradiated onto a substrate 1*a* of the thermal transfer recording medium 1, the strength of the resin of the substrate 1*a* is not deteriorated each time the ultraviolet light is irradiated onto it.

Next, an apparatus for renewing a thermal transfer recording medium of this embodiment and a thermal transfer printer having this renewing apparatus will be described respectively using FIG. 5 and FIG. 6.

Figure 5:
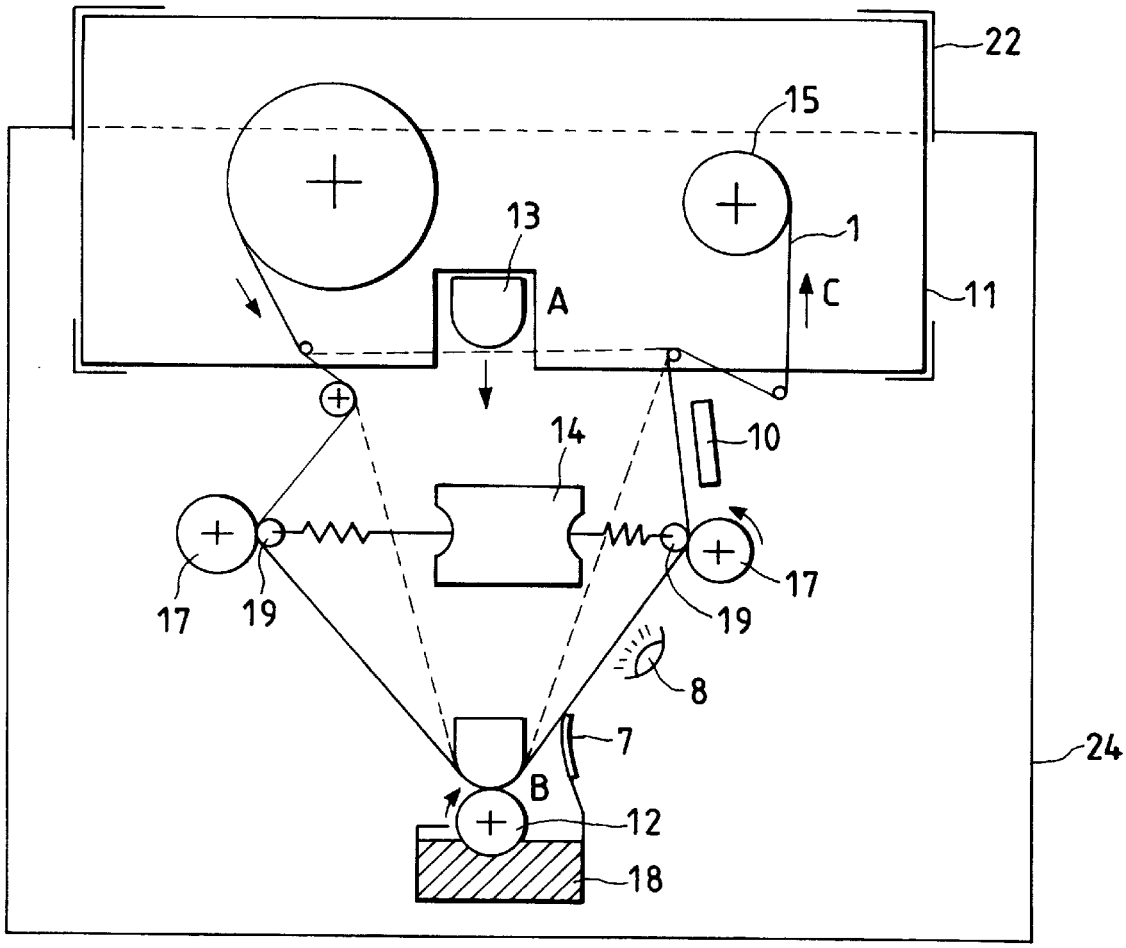
FIG. 5 is a schematic configuration diagram showing another embodiment of an apparatus for renewing a thermal transfer recording medium of the invention.

At first, since the embodiment in FIG. 5 is a modification of the embodiment of FIG. 2 as above described, the descriptions of similar configurations to FIG. 2 shall be omitted and only different configurations from FIG. 2 will be described.

In FIG. 5, at a position corresponding to the cleaning roller 9 of FIG. 2, a simple guide roller 17 is arranged. Guide roller 17 does not have a cleaning function because the cleaning is not necessary according to the embodiment of FIG. 4.

The ultraviolet irradiator 8, used to harden the thermal transfer recording material applied to the thermal transfer recording medium 1, is arranged on the outside of the thermal transfer recording medium 1 so that the ultraviolet irradiator 8 is opposed to the ink layer of the thermal transfer recording medium 1 between the recording material feed roller 12 and the guide roller 17 at the downstream side from the roller 12 in the traveling direction of the thermal transfer recording medium 1.

Next, operation of the renewing apparatus of this embodiment will be described.

A ribbon cassette 11 is installed to a holder 22, a tension head 13 is moved from A to B in the figure, the thermal transfer recording medium 1 is hooked to the tension head 13 and is drawn out of the ribbon cassette 11 and the surface on the opposite side of the substrate is pressed to the recording material feed roller 12. Subsequently, a tension unit 14 at the retracted position is moved in the vertical direction with respect to the paper plane and is stopped at the advanced position, and a pair of tension rollers 19, 19 supported by the tension unit 14 are pressed to guide rollers 17, 17, respectively, and the thermal transfer recording medium 1 is grasped between each tension roller 19 and each guide roller 17, respectively, to thereby finish the preparation of the traveling system of the thermal transfer recording medium 1. In this state, a winding bobbin 15 of the ribbon cassette 11 is driven for rotation by driving means (not shown) installed to the renewing apparatus 24 whereby the thermal transfer recording medium 1 is traveled in the direction shown by arrow C in the figure. Due to the traveling of the thermal transfer recording medium 1, the thermal transfer recording material is applied to the whole surface of the thermal transfer recording medium 1 by the ink feed roller 12. The film thickness of the thermal transfer recording material applied onto the thermal transfer recording medium 1 is made uniform by a film thickness control device 7. Ultraviolet light is then irradiated from the ink layer side of the surface of the thermal transfer recording medium 1 by an ultraviolet irradiator 8 whereby all thermal transfer recording material applied onto the ink lacking portion and the remaining ink layer is hardened. The ink layer is thus renewed in the ink lacking portion and a new ink layer is further laminated thinly on the remaining ink layer.

A boundary part between the renewed ink layer and the remaining ink layer on the thermal transfer recording medium 1 is then eliminated by the anneal processing performed by the heating device 10. This completes a series of renewing process of the thermal transfer recording medium 1.

Figure 6:
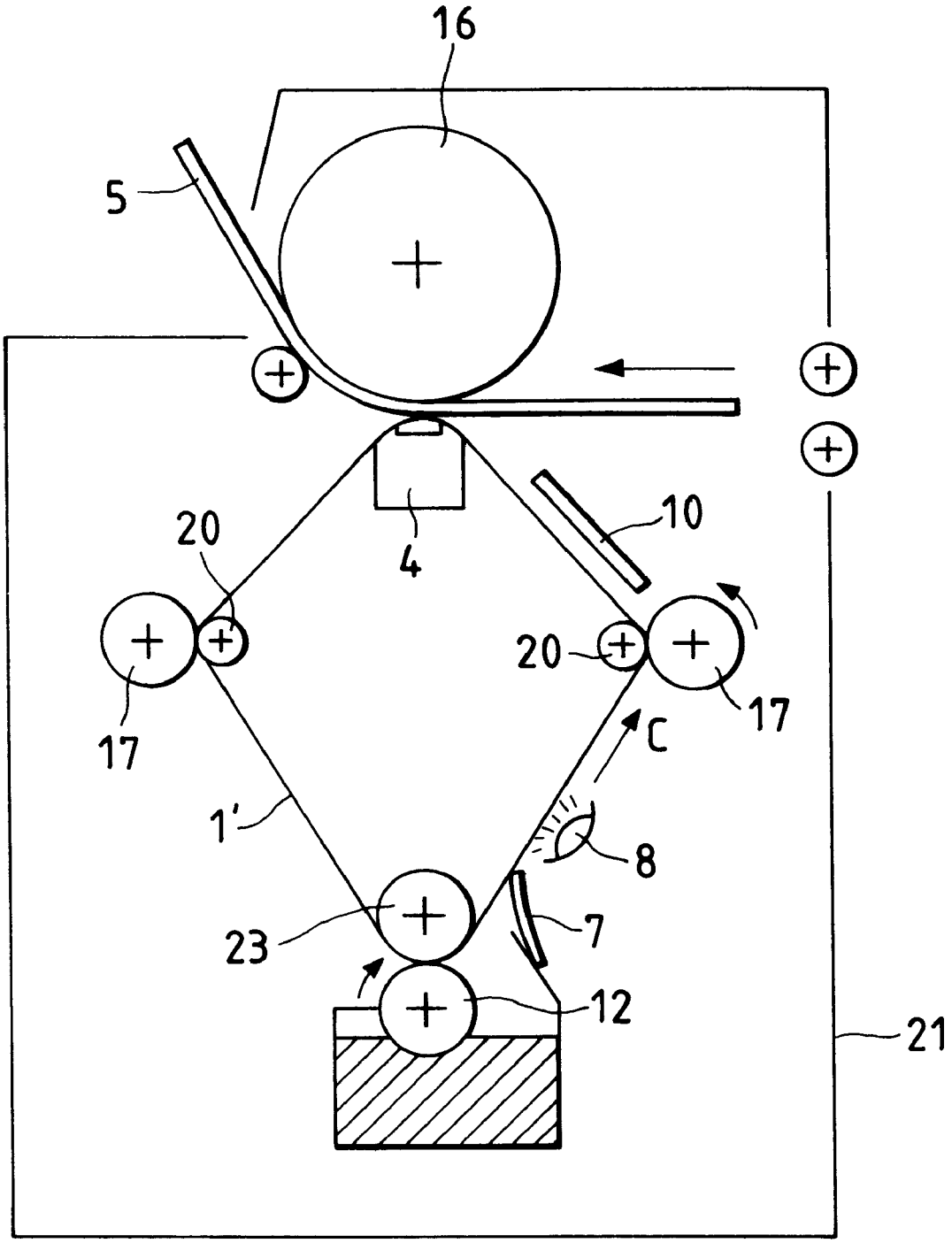
FIG. 6 is a schematic configuration diagram showing another embodiment of a thermal transfer recording apparatus of the invention.
Figure 7:
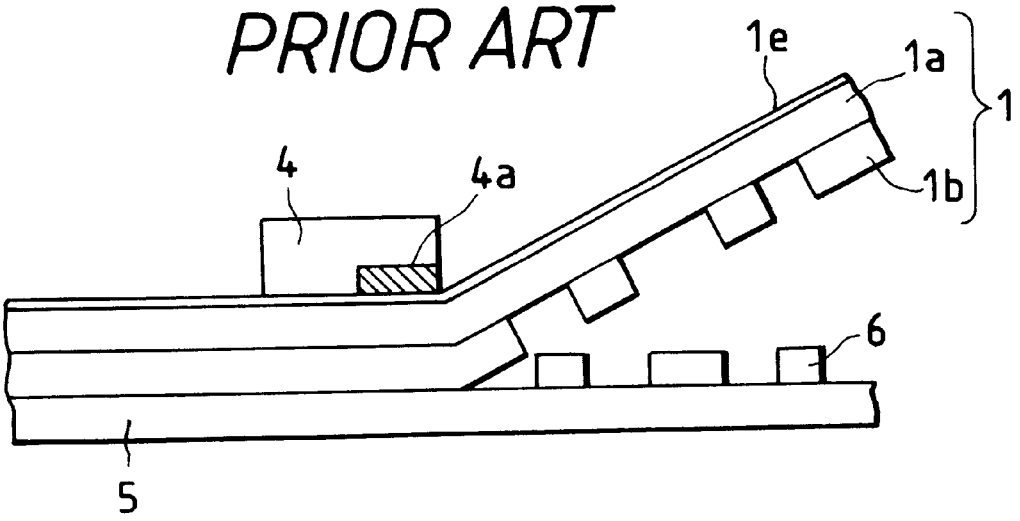
FIG. 7 PRIOR ART
FIG. 7 is a schematic sectional view showing a configuration and recording principle of a prior art heat fusion type ink ribbon.
Figure 8:
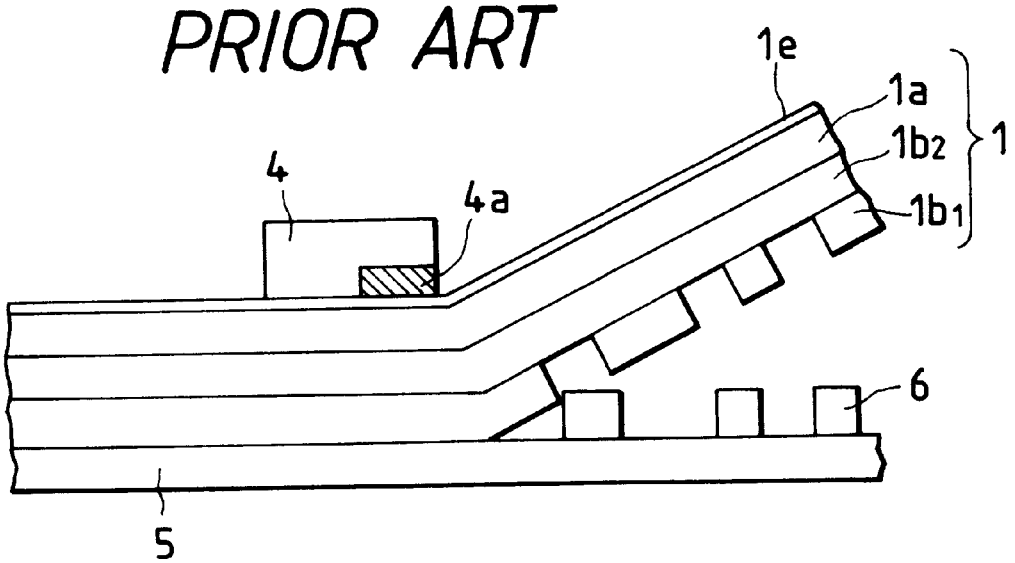
FIG. 8 PRIOR ART
FIG. 8 is a schematic sectional view explaining a configuration and recording principle of a multi-time ink ribbon in the prior art.

Next, since the thermal transfer printer in FIG. 6 is a modification of the embodiment of FIG. 3 as described above, the description of similar configurations to FIG. 3 shall be omitted and only different configurations from FIG. 3 will be described.

Also in the embodiment of FIG. 6, the cleaning roller, as in FIG. 3, is not used, and in place of this, a guide roller 17 pressed to a guide roller 20 is provided. Also, an ultraviolet irradiator 8 used to harden the thermal transfer recording material applied to the thermal transfer recording medium 1 is arranged to the outside of the thermal transfer recording medium 1 so that the ultraviolet irradiator 8 is opposed to the ink layer of the thermal transfer recording medium 1 between the recording material feed roller 12 and the guide roller 17 at the downstream side from the roller 12 in the traveling direction of the thermal transfer recording medium 1.

Next, operation of the thermal transfer recording apparatus of this embodiment will be described.

First, a recording paper 5 is sent between a thermal head 4 and a platen roller 16. Then, ink from an endless ink ribbon 1' positioned between the recording paper 5 and the thermal head 4 is subjected to thermal transfer by the thermal head 4 as in a conventional thermal transfer recording apparatus to thereby carry out the desired printing recording.

An ink lacking portion produced in the ink ribbon 1' due to the ink transfer is moved to the recording material feed roller 12 located opposite the platen roller 16 by transferring the ink ribbon 1'. In this position, the thermal transfer recording material within a recording material tank 18 is pumped up to the recording material feed roller 12 and applied to the whole surface of the ink ribbon 1'. The film thickness of the applied thermal transfer recording material is controlled by a film thickness control device 7. Ultraviolet light is irradiated from the ink layer side by an ultraviolet irradiator 8 and the thermal transfer recording material applied to the ink lacking portion and the remaining ink layer is hardened to thereby renew the ink layer.

The heating device 10 eliminates a boundary part between the renewed ink layer and the remaining ink layer by anneal processing. This completes a series of the renewing process of the thermal transfer recording medium and the renewed ink ribbon 1' is sent to the thermal head 4 and used again for printing.

According to the embodiment in FIG. 5 and FIG. 6 as above described, the cleaning means is not required, and there is no fear that the strength of the resin which constitutes the substrate of the thermal transfer recording medium will be deteriorated by the repeated light irradiation.

Furthermore, normally in anaerobic photosetting resin, since oxygen acts as a polymerization stopping agent of reactive radical, chain growth is stopped by low molecular compounds in the air and non-hardened monomer or prepolymer remains as residue. However, when ultraviolet irradiation is carried out from the surface of the ink layer of the thermal transfer recording medium as in this embodiment, since the hardening progresses from the uppermost surface, oxygen is interrupted in the non-hardened ink layer in the vicinity of the substrate and the polymerization progresses to the inside of the layer with high efficiency.

Embodiments of FIG. 5 and FIG. 6 will be shown.

Embodiment 5

Ultraviolet setting ink, as a thermal transfer recording material, was prepared by adding: (1) hydroxyl alkyl methacrylate (75 parts by weight), acrylic acid (10 parts by weight) and polyurethane dimethacrylate (10 parts by weight) as an ultraviolet setting resin; (2) a compound of acetophenone series (5 parts by weight) as an optical reaction initiator; and (3) carbon black (5 parts by weight) as a coloring agent.

The prepared ink was put into a coating liquid pan, and PET film surface of 3.5 $\mu$m in thickness manufactured by Teijin, Ltd. subjected to the rear surface processing by Saimac US350/MEK solution manufactured by Toa Gosei Chemical Industry Co., Ltd. was subjected to the gravure coating. Ultraviolet light having a center wavelength of 365 nm and 20 mW/cm$^2$ was then irradiated onto the whole surface of the film from the ink layer surface for 3 minutes whereby the ink was hardened and an ink ribbon as the thermal transfer recording medium was manufactured.

When this ink ribbon was installed to a thermal transfer printer (resolving power 400 dpi) manufactured by Star Seimitsu Company and the printing was carried out, image of good edge reproducibility was obtained in the image density 1.3.

Then, the used ink ribbon was placed in a renewing apparatus of configuration shown in FIG. 5, coating of ink of the above-mentioned composition and ultraviolet irradiation from the ink layer surface were carried out in the above-mentioned method and procedure and the renewal of the ink ribbon was completed. In this embodiment, since the ink layer was renewed throughout the whole surface, the cleaning method was not needed.

When the ink ribbon, renewed in such manner, was installed to the printer and the printing was carried out again, image of good edge reproducibility was obtained in the image density 1.3, and was by no means inferior to the preceding case.

What is claimed is:

1. An apparatus for forming an ink layer on a substrate of a thermal transfer recording medium, comprising:

liquid thermal transfer recording material including at least one of a photopolymerizing monomer and a photopolymerizing polymer;

means for applying said liquid thermal transfer recording material onto a substrate; and means for irradiating light onto said liquid thermal transfer recording material such that said liquid thermal transfer recording material is hardened on said substrate to form said ink layer.

2. A manufacturing apparatus as set forth in claim 1, wherein the light irradiating means is an ultraviolet irradiator.

3. An apparatus for reconditioning a previously-used thermal transfer recording medium, the previously-used thermal transfer recording medium including a transparent substrate and an ink layer formed on the substrate, wherein the ink layer includes an upper surface and defines openings where portions of the ink layer are removed, the apparatus comprising:

liquid thermal transfer recording material including at least one of a photopolymerizing monomer and a photopolymerizing polymer;

means for applying said liquid thermal transfer recording material onto the upper surface of the ink layer and into the openings defined in the ink layer; and light irradiating means for irradiating light onto said transparent substrate such that light passes through the transparent substrate and hardens first portions of the liquid thermal transfer recording material located in the openings defined in the ink layer, wherein the ink layer shields second portions of the thermal transfer recording material located on the upper surface of the ink layer such that the second portions remain liquid.

4. A renewing apparatus as set forth in claim 3, wherein the light irradiating means is an ultraviolet irradiator.

5. A renewing apparatus as set forth in claim 3, further comprising means for removing the second portions of liquid thermal transfer recording material located on the ink layer.

6. A method for manufacturing a thermal transfer recording medium including a substrate and an ink layer formed on the substrate, the method comprising the steps of:

applying a liquid thermal transfer recording material onto the substrate, the liquid thermal transfer recording material including at least one of a photopolymerizing monomer and a photopolymerizing polymer; and irradiating light onto the thermal transfer recording medium such that the liquid thermal transfer recording material is hardened to form the ink layer.

7. The method according to claim 6, wherein the step of irradiated light comprises irradiating ultraviolet light.

8. A method for reconditioning a previously-used thermal transfer recording medium, the previously-used thermal transfer recording medium including a transparent substrate and an ink layer formed on the substrate, wherein the ink layer includes an upper surface and defines openings created during previous use of the thermal transfer recording medium, the method comprising the steps of:

applying a liquid thermal transfer recording material onto the upper surface of the ink layer and into the openings defined in the ink layer, the thermal transfer recording material including at least one of a photopolymerizing monomer and a photopolymerizing polymer; and irradiating light onto said transparent substrate such that light passes through the transparent substrate and hardens first portions of the liquid thermal transfer recording material located in the openings defined in the ink layer, wherein the ink layer shields second portions of the thermal transfer recording material located on the upper surface of the ink layer such that the second portions remain liquid.

9. The method according to claim 8, wherein the step of irradiating light comprises irradiating ultraviolet light.

10. The method according to claim 8, further comprising the step of removing the second portions of the liquid thermal transfer recording material located on the ink layer.

* * * * *

UNITED STATES PATENT AND TRADEMARK OFFICE

CERTIFICATE OF CORRECTION

PATENT NO. : 6,011,573
DATED : January 4, 2000
INVENTOR(S) : Yuji Nagahamaya et al.

It is certified that error appears in the above-identified patent and that said Letters Patent is hereby corrected as shown below:

Title page,
ABSTRACT, line 8, delete "polymer" and substitute -- prepolymer -- in its place.

Signed and Sealed this

Twenty-sixth Day of February, 2002

*Attest:*

*Attesting Officer*

JAMES E. ROGAN
*Director of the United States Patent and Trademark Office*